US006079058A

United States Patent [19]

Green

[11] Patent Number: 6,079,058

[45] Date of Patent: Jun. 27, 2000

[54] INFLATABLE TOILET WITH DISPOSABLE BAG

[76] Inventor: Michael E. Green, 2625 Piedmont Rd., Bldg. 56-199, Atlanta, Ga. 30324

[21] Appl. No.: 09/292,900

[22] Filed: Apr. 16, 1999

[51] Int. Cl.[7] ..... A47K 11/06

[52] U.S. Cl. ..... 4/484; 4/479

[58] Field of Search ..... 4/483, 484, 479, 4/450, 452

[56] References Cited

U.S. PATENT DOCUMENTS

| | | | |
|---|---|---|---|
| 1,127,151 | 2/1915 | Alford | 4/484 |
| 1,663,966 | 3/1928 | Ament et al. | 4/142 |
| 2,376,036 | 5/1945 | Cotton | 4/116 |
| 2,801,426 | 8/1957 | La Gorce et al. | 4/142 |
| 2,923,950 | 2/1960 | Carter | 4/483 X |
| 2,974,321 | 3/1961 | Salka | 4/134 |
| 3,381,315 | 5/1968 | Glassberg | 4/142 |
| 3,495,278 | 2/1970 | Peters | 4/142 |
| 3,605,127 | 9/1971 | Dailey | 4/484 X |
| 4,909,268 | 3/1990 | Maggio | 135/88 |
| 5,129,111 | 7/1992 | Feinzilberg | 4/484 |

FOREIGN PATENT DOCUMENTS

| | | | |
|---|---|---|---|
| 0686682 | 1/1953 | United Kingdom | 4/484 |
| 2246705 | 2/1992 | United Kingdom | 4/484 |

*Primary Examiner*—Charles E. Phillips
*Attorney, Agent, or Firm*—Thomas, Kayden, Horstemeyer & Risley, L.L.P.

[57] ABSTRACT

A preferred embodiment of the inflatable toilet of the present invention incorporates an inflatable support structure which includes a top and defines a cavity. The top has a first aperture sidewall defining a first aperture that provides access to the cavity. Additionally, the aperture sidewall includes a lower portion which extends into the cavity. A disposable bag, which preferably includes an adhesive laden open end, is removably attached to the lower portion of the aperture sidewall for receiving waste. The first sidewall also defines a second aperture configured for providing access to the cavity so that the disposable bag can be removed from the lower portion of the interior aperture wall and withdrawn from the cavity. In some embodiments, a lid also is provided, with the lid being configured to cover the first aperture when in a closed position.

11 Claims, 3 Drawing Sheets

INFLATABLE TOILET WITH DISPOSABLE BAG

CROSS REFERENCE TO RELATED APPLICATIONS

This application is based on and claims priority to U.S. Provisional Application Ser. No. 60/082,054, filed on Apr. 16, 1998.

BACKGROUND OF THE INVENTION

1. Field of the Invention

The present invention relates to commodes. More specifically, the present invention relates to a collapsible device that inflates to provide a portable, lightweight commode.

2. Description of the Related Art

One of the most significant milestones in the behavioral development of a child is becoming "potty-trained." In order to achieve "potty-trained" status, a child must engage in an uninterrupted pattern of using lavatory facilities so that using a diaper will no longer be necessary. However, lavatory facilities are not always readily available. This is particularly so when traveling by car in an area of the country that has a limited number of rest stops, or when traveling during late evening or early morning hours when lavatory facilities are not open for use.

To overcome this problem, a number of prior art portable toilets have been developed. Some of these prior art devices resemble miniature versions of standard commodes with the devices typically being made of a durable material, such as plastic. Typically, these devices incorporate a base which houses a removable basin for collecting waste. Although devices of this type provide a portable commode to aid in "potty training," these devices often are rigidly formed and, therefore, take up much needed storage space within a vehicle. Additionally, these devices typically do not provide a sanitary method for the disposal of waste which is collected in the incorporated basin.

Therefore, it is desirable to provide a portable commode which addresses these and other shortcomings of the prior art.

BRIEF SUMMARY OF THE INVENTION

Briefly described, a preferred embodiment of the inflatable toilet of the present invention incorporates an inflatable support structure which includes a top and defines a cavity. The top has a first aperture sidewall defining a first aperture that provides access to the cavity. Additionally, the aperture sidewall includes a lower portion which extends into the cavity. A disposable bag, which preferably includes an adhesive laden open end, is removably attached to the lower portion of the aperture sidewall for receiving waste. The first sidewall also defines a second aperture configured for providing access to the cavity so that the disposable bag can be removed from the lower portion of the interior aperture wall and withdrawn from the cavity. In some embodiments, a lid also is provided, with the lid being configured to cover the first aperture when in a closed position.

In accordance with another aspect of the present invention, some embodiments incorporate a second sidewall, with the first sidewall and the second sidewall forming inflatable air bladders of the support structure. In some of these embodiments, the top and the base of the support structure are configured as a non-inflatable portions of the support structure.

In accordance with another aspect of the present invention, the support structure can include a first air bladder communicating between the first sidewall and the top.

In accordance with still another aspect of the present invention, the support structure can be mounted within a case, with the case having a rigid base portion and a case lid movably attached to the rigid base portion. The case is adapted for storing the support structure when the support structure is deflated, and then, when the case is opened and the support structure is inflated, the case provides a rigid base for the base of the support structure.

In accordance with yet another aspect of the present invention, the inflatable toilet can incorporate a removable bowl which is configured to engage the first aperture sidewall, thus providing another sanitary manner for receiving and disposing of waste.

Other features and advantages of the present invention will become apparent to one with skill in the art upon examination of the following drawings and detailed description. It is intended that all such additional features and advantages be included herein within the scope of the present invention, as defined by the claims.

BRIEF DESCRIPTION OF THE SEVERAL VIEWS OF THE DRAWINGS

The accompanying drawings incorporated in and forming a part of the specification illustrate several aspects of the present inventions, and together with the description serve to explain the principles of the inventions. The components in the drawings are not necessarily to scale, emphasis instead being placed upon clearly illustrating principles of the present inventions.

DETAILED DESCRIPTION OF THE PREFERRED EMBODIMENT

Figure 1:
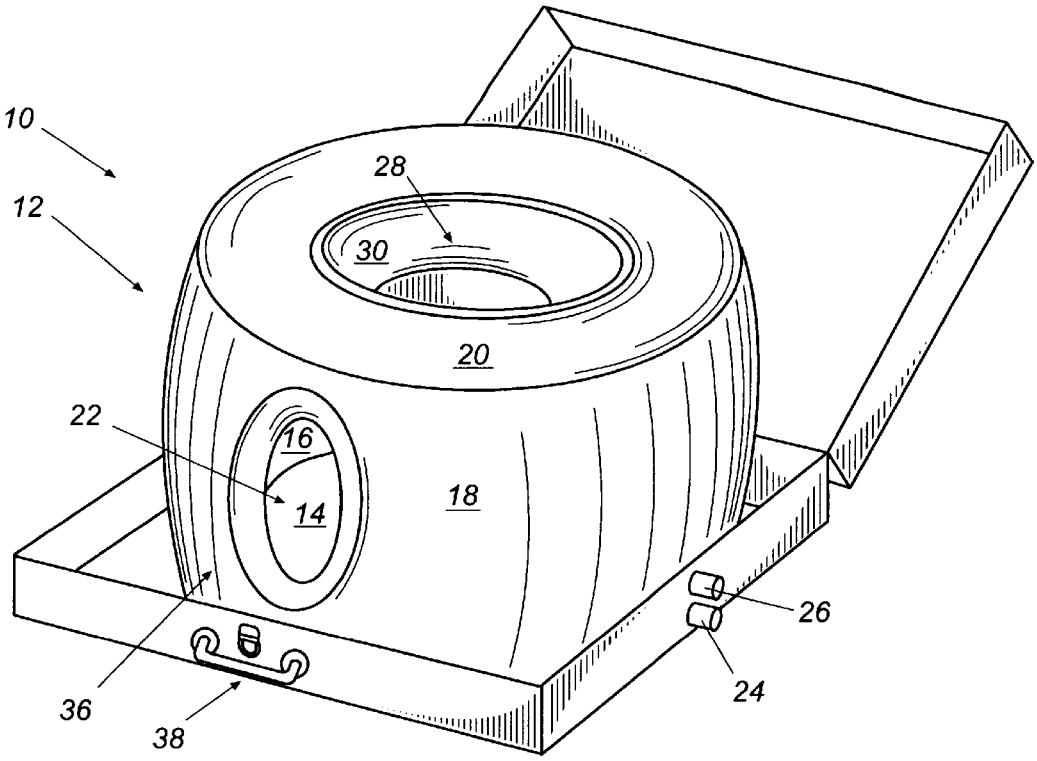
FIG. 1 illustrates a perspective view of a preferred embodiment of the present invention incorporating opposed sidewall apertures and a carrying case.

Reference will now be made in detail to the description of the present invention as illustrated in the drawings with like numerals indicating like parts throughout the several views. As shown in FIG. 1, the preferred embodiment of the inflatable toilet 10 of the present invention includes an inflatable support structure 12 generally in the form of a cylinder having a base 14, interior and exterior sidewalls 16 and 18 and a top 20, with the support structure 12 defining a central cavity 22. The support structure 12 is formed of lightweight, durable vinyl or other suitable material and is configured so that the structure can be inflated by blowing air through an incorporated nozzle 24 or pumping air through an air compressor-adaptable nozzle 26 so as to form a seat which is capable of supporting the weight of a child seated upon the top 20.

Figure 2:
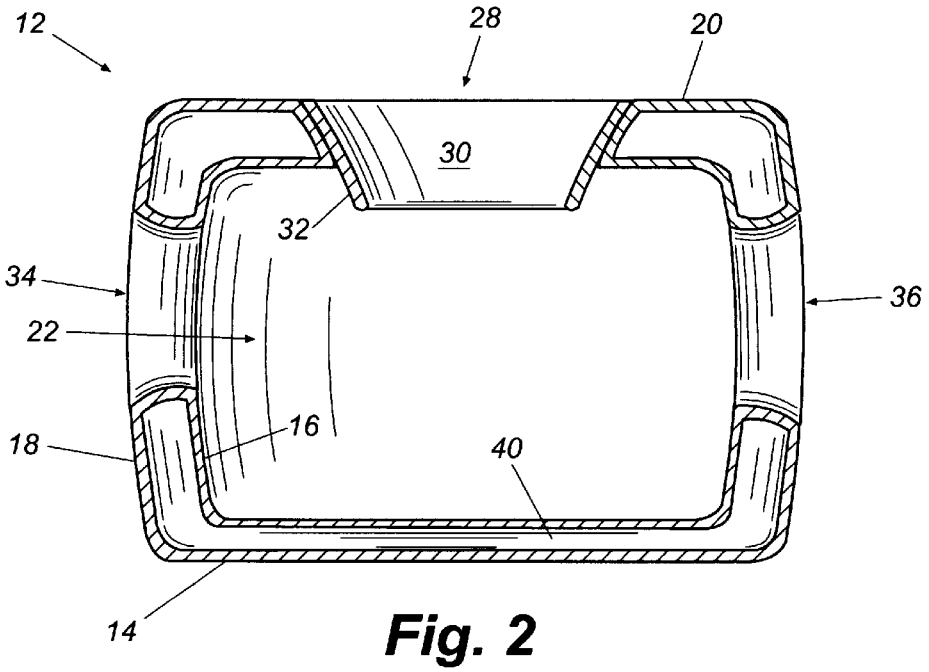
FIG. 2 illustrates a cross-sectional side view of the embodiment of FIG. 1, with the carrying case removed.

As shown in FIG. 2, an upper aperture 28, defined by an upper aperture sidewall 30, is formed in the top for providing access to the central cavity with a lower portion 32 of the upper aperture sidewall 30 extending downwardly into the cavity 22. The lower portion 32 of the sidewall 30 is adapted to receive the open end of a disposable bag (not shown) so that the bag is positioned to receive waste which is passed through the upper aperture 28. A pair of opposed apertures 34 and 36 are formed in the sidewalls 16 and 18 of the support structure 12 for allowing attachment and subsequent removal of a disposable bag from the cavity 22. Additionally, in some embodiments, the disposable bag is attached to a funnel insert (not shown), formed of a material such as plastic, which cooperates with the upper aperture sidewall, thereby providing a rigid attachment surface for the bag.

A carrying case 38 (FIG. 1) is also provided in some embodiments for providing a convenient means for transporting and storing the inflatable toilet 10. Although shown in FIG. 1 as a rigid case, other embodiments of the carrying case 38 incorporate side panels formed of the same material as the support structure 12, i.e. vinyl, with a zipper extending about a portion of the periphery of the case panel so that the support structure can be deflated and encased within the soft, zippered carrying case. Additionally, the carrying case 38 can serve as a rigid base portion to provide additional stability to the support structure when the support structure is left within the case 38 (FIG. 1) during use, or the structure 12 can be conveniently removed from the case prior to use when the rigid base is not required.

Figure 4:
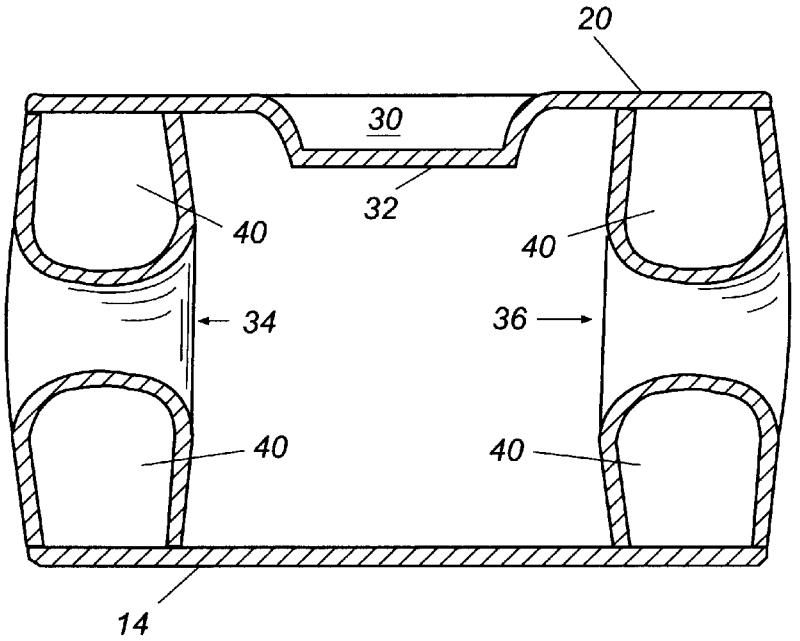
FIG. 4 illustrates a cross-sectional side view of an alternative embodiment of the present invention.

As shown in FIG. 2, interior and exterior sidewalls 16 and 18 cooperate to form a continuous air bladder 40 which is inflatable to form a semi-rigid structure 12. It is anticipated that the air bladder 40 also can be segmented into numerous separate bladders (FIG. 4) of various shapes and sizes in order to facilitate ease of construction as well as to provide added structural support to the various embodiments. Additionally, it can be seen that the sidewall apertures 34 and 36 are oriented to allow a person to reach one hand through each aperture to gain access to the cavity 22.

Figure 3B:
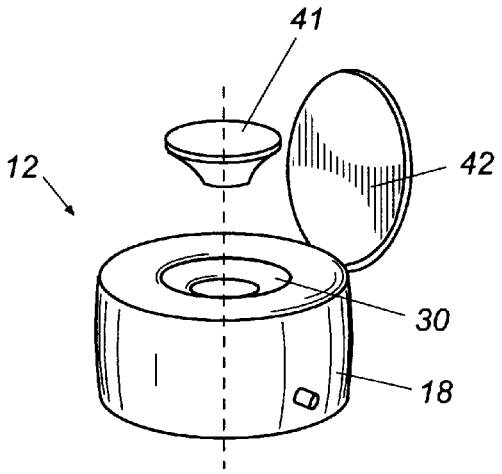
FIG. 3*b* illustrates a perspective view of the embodiment of FIG. 3*a* which has been deflated for storage.
Figure 3A:
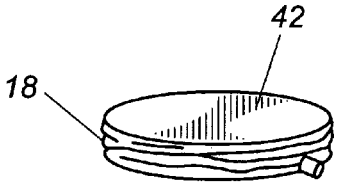
FIG. 3*a* illustrates a perspective view of an alternative embodiment of the present invention incorporating a removable basin and a lid.

As shown in FIGS. 3*a* and 3*b*, some embodiments of the present invention also can incorporate a removeable bowl 41 which is adapted to cooperate with upper aperture sidewall 30. After use, the bowl 41 can be conveniently removed and cleaned, and then placed back into the aperture 28 for storage. A lid 42 also can be provided to cover the top 20 and the upper aperture 28 (lid 42 shown in a closed position, FIG. 3*b*, with the support structure 12 deflated).

Figure 5:
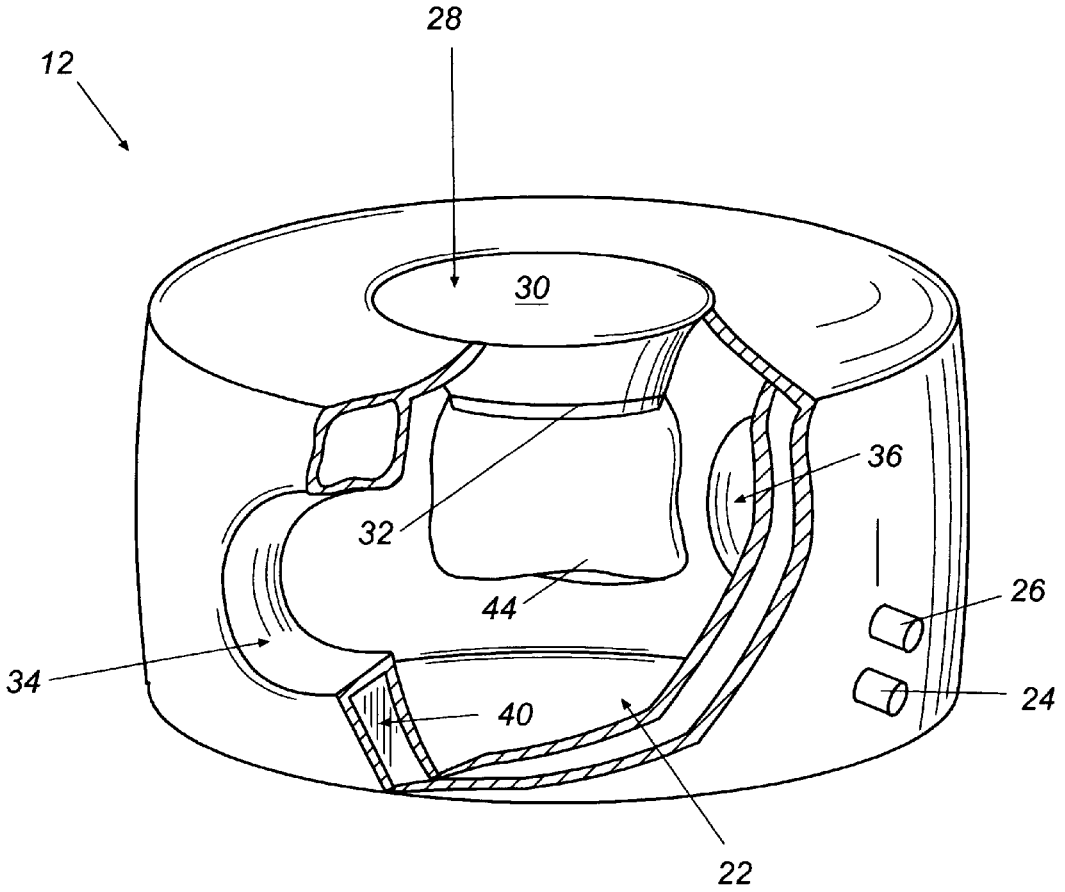
FIG. 5 illustrates a partially cut-away view of an embodiment of the present invention showing detail of the cavity, with a disposable bag attached to the upper aperture sidewall.

As shown in FIG. 5, the preferred embodiment of the inflatable toilet 10 operates by removing the structure 12 from the carrying case 38 (if included), and inflating the structure 12 by either blowing air into the nozzle 24 (not shown), or attaching an air compressor to the air compressor-nozzle 26 (not shown) and pumping air into the bladder 40 until the structure 12 is inflated to a suitable pressure. A disposable bag 44, such as a plastic bag incorporating an adhesive on the edge of its open end, is then placed through one of the sidewall apertures 34 and 36 and into the cavity 22, and then oriented so that the open end of the bag 44 aligns with the lower portion 32 of the upper aperture sidewall 30. The bag 44 is then attached to the lower portion 32 by sticking the adhesive laden edge of the bag against the periphery of the lower portion 32 such that the bag 44 forms and tight seal with the entire lower portion 32. At this time the toilet 10 can be used with any waste being allowed to fill the bag 44. Additionally, other suitable methods for forming a tight seal between the bag 44 and the lower portion 32 include velcro fasteners, elastic bands, etc.

After use, the bag 44 is removed from the cavity by a person inserting a hand through each of the apertures 34 and 36 and gently disengaging the adhesive seal of the bag 44 from the lower portion 32. The bag 44 can then be sealed by sticking the adhesive portion of the bag 44 to itself, and then the bag 44 can be removed from the structure 12 for proper disposal.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

What is claimed is:

1. An inflatable toilet comprising:

an inflatable support structure having a base, a first sidewall extending upwardly from said base, a top attached to said first sidewall, and a nozzle for inflating said support structure, said support structure defining a cavity, said top having a first aperture sidewall defining a first aperture, said first aperture providing access to said cavity, said aperture sidewall having a lower portion extending into said cavity, and;

a disposable bag removably attached to said lower portion of said aperture sidewall for receiving waste therein;

said first sidewall defining a second aperture configured for providing access to said cavity such that said disposable bag can be removed from said lower portion of said interior aperture wall and withdrawn from said cavity through said second aperture.

2. The inflatable toilet of claim 1, wherein said first sidewall defines a third aperture configured for providing access to said cavity, said third aperture opposing said second aperture such that said disposable bag can be removed from said lower portion of said interior aperture wall and withdrawn from said cavity through said third aperture.

3. The inflatable toilet of claim 1, wherein said inflatable toilet has a removable bowl, said bowl configured to engage said first aperture sidewall.

4. The inflatable toilet of claim 1 wherein said disposable bag has an open end, said open end being laden with an adhesive such that said adhesive facilitates attachment of said disposable bag said lower portion of said aperture sidewall.

5. An inflatable toilet comprising:

an inflatable support structure having a base, a first sidewall extending upwardly from said base, a top attached to said first sidewall, and a nozzle for inflating said support structure, said support structure defining a cavity, said top having a first aperture sidewall defining a first aperture, said first aperture providing access to said cavity, said aperture sidewall having a lower portion extending into said cavity;

a disposable bag removably attached to said lower portion of said aperture sidewall for receiving waste therein;

said first sidewall defining a second aperture configured for providing access to said cavity such that said disposable bag can be removed from said lower portion of said interior aperture wall and withdrawn from said cavity through said second aperture, and;

a lid movably attached to said support structure, said lid being moveable between an open position and a closed position, in said closed position, said lid covering said first aperture and at least a portion of said top.

6. The inflatable toilet of claim 5, wherein said support structure has a second sidewall, said first sidewall and said second sidewall forming inflatable air bladders of said support structure, said top and said base being configured as a non-inflatable portions of said support structure.

7. The inflatable toilet of claim 5, wherein said support structure has a first air bladder communicating between said first sidewall and said top.

8. The inflatable toilet of claim 5, wherein said support structure is mounted within a case, said case having a rigid base portion and a case lid movably attached to said rigid base portion, said case lid being moveable between an open position and a closed position, in said closed position, said case lid and said rigid base portion configured for encasing said support structure, said base of said support structure engaging said rigid base portion.

9. The inflatable toilet of claim 5, wherein said first sidewall defines a third aperture configured for providing access to said cavity, said third aperture opposing said second aperture such that said disposable bag can be removed from said lower portion of said interior aperture wall and withdrawn from said cavity through said third aperture.

10. The inflatable toilet of claim 5, wherein said inflatable toilet has a removable bowl, said bowl configured to engage said first aperture sidewall.

11. The inflatable toilet of claim 5, wherein said disposable bag has an open end, said open end being laden with an adhesive such that said adhesive facilitates attachment of said disposable bag said lower portion of said aperture sidewall.

* * * * *